US011445797B1

(12) United States Patent
Zheng et al.

(10) Patent No.: US 11,445,797 B1
(45) Date of Patent: Sep. 20, 2022

(54) DISPENSER WITH A REPLACEABLE INNER CASE

(71) Applicant: APR Beauty Group Inc, Toronto (CA)

(72) Inventors: Min-Yan Zheng, Toronto (CA); Feng-Ying Fu, Markham (CA); Jun Shen, Lighthouse Point, FL (US)

(73) Assignee: APR Beauty Group, Inc., Toronto (CA)

( * ) Notice: Subject to any disclaimer, the term of this patent is extended or adjusted under 35 U.S.C. 154(b) by 0 days.

(21) Appl. No.: 17/351,431

(22) Filed: Jun. 18, 2021

(51) Int. Cl.
*A45D 34/04* (2006.01)
*B05B 11/00* (2006.01)

(52) U.S. Cl.
CPC ..... *A45D 34/04* (2013.01); *B05B 11/0054* (2013.01); *B05B 11/3001* (2013.01); *B05B 11/3045* (2013.01); *A45D 2200/055* (2013.01)

(58) Field of Classification Search
CPC ..... A45D 34/04; A45D 2200/055; B05B 11/0054; B05B 11/3001; B05B 11/3045
See application file for complete search history.

(56) References Cited

U.S. PATENT DOCUMENTS 9,370,233 B2 * 6/2016 Jung ..... B05B 11/3026
10,781,033 B1 * 9/2020 Bulla ..... B65D 83/38
2010/0098480 A1 * 4/2010 Byeon ..... B05B 11/3053 401/136
2012/0174919 A1 * 7/2012 Hausmann ..... B05B 11/3042 128/200.23
2012/0267391 A1 * 10/2012 Yoo ..... A45D 34/00 222/23
2017/0036226 A1 * 2/2017 Goettke ..... B05B 15/65
2019/0060929 A1 * 2/2019 Delmon ..... B05B 11/0038
2022/0047820 A1 * 2/2022 Säll ..... B05B 11/3052

FOREIGN PATENT DOCUMENTS

KR 101218932 B1 1/2013

* cited by examiner

*Primary Examiner* — Vishal Pancholi
(74) *Attorney, Agent, or Firm* — Jason Lee DeFrancesco

(57) ABSTRACT

A dispenser for dispensing a liquid product, the dispenser comprising an inner case, a pump assembly, a dispensing head, a collar, a dialer, and an outer case. The inner case accommodates the liquid product. The outer case removably houses the inner case in a hollow cavity formed therein. The dialer is rotatable on an outer surface of the outer case. The dialer is detachably coupled with the inner case which allows the inner case to be housed within the outer case in a removable manner. The dialer is rotated circumferentially on an outer peripheral surface of the outer case for engaging and disengages the inner case. The collar is designed to house the pump assembly and is engaged on an open upper end of the outer case. The dispensing head is coupled to the pump assembly and comprises a nozzle to dispense the pumped liquid product when actuated.

20 Claims, 8 Drawing Sheets

DISPENSER WITH A REPLACEABLE INNER CASE

BACKGROUND

Field

The present disclosure relates to a dispenser for dispensing liquid product(s). More particularly, the present disclosure relates to a dispenser having an outer case and inner case, wherein the inner case, that houses a liquid product, is replaceable with a new inner case.

Description of the Related Art

A liquid product dispenser is used for storing the liquid product inside the containers and dispense the liquid product as per user requirement of the user. Conventional dispensers are used for storing liquid product which are often disposable. These dispensers usually have a fixed container portion that is disposed along with the dispenser body after use. The disposable dispensers usually come with a dispensing head, a pump assembly, and a single-use type container that is not capable of being reused. These dispensers are used in storing liquid based or gel-based formulations that can be dispensed directly onto the skin of the user. The liquid product includes soap based liquid products, cosmetic formulations, skin care liquid products and the like.

Korean Patent No. KR101218932B1 to LG household & health care co., ltd., discloses about a refillable cosmetic container. The refill container provided with a dispenser in the upper portion. A container body at least partially accommodates the refill container, and a rotating member is rotatably fitted to the upper outer surface of the container body. When one of the container body and the rotating member is rotated relative to the other one, the refill container in the container body is detached from the locked state or vice versa.

Existing dispensers dispenses the liquid products stored therein and the refill container along with the dispensing mechanism is disposed when the product is exhausted. A new dispenser is purchased each time along with the liquid product, whenever the liquid product is exhausted or a different liquid product is to be used by user. These conventional methods of disposing off the dispenser upon being exhausted with a new dispenser or purchasing different dispensers for accumulating different liquid product leads to accumulation of large number of plastics that ultimately leads to incineration of plastics. Purchasing dispensers each time may include a lot of expenses and liquid product. The incineration of plastic may further lead to environmental degradation and increase in carbon footprint. These incinerated plastics are later burnt out along with other waste materials that leads to liquid product of toxic fumes.

In order to overcome the above-mentioned limitations, there exists a need of developing a dispenser that is replenished by a user upon being exhausted, simultaneously managing the over wastage of liquid product, thus reducing incineration of plastic and ultimately minimizes carbon footprint. The present disclosure is therefore related to a dispenser having a replaceable inner case that is easily detached from the dispenser and replenished easily, thereby making the dispenser reusable, refillable and cost-effective.

SUMMARY

It is an object of the present disclosure to provide a dispenser for dispensing a liquid product with a replaceable inner case.

It is an object of the present disclosure to provide a dispenser with an inner case that can easily be detached for replacement.

Accordingly, there is provided a dispenser comprising a top cover, a dispensing head, a collar, a pump assembly, a piston, an inner case, a dialer, an outer case, a holder, and a base cover. The inner case stores a liquid product that is to be dispensed onto an outer surface of the dispensing head, wherein the liquid product is selected from at least one of the cosmetic liquid products or medicinal liquid products. The liquid product stored in the inner case is a flowable liquid product e.g. a solution, suspension, a viscous liquid, etc.

According to an aspect of the present disclosure, the inner case is replaceable and is removably housed within the outer case. The inner case, when housed in the outer case, is detachably attached to the dialer such that the outer case, the dialer, the collar, the pump assembly, and the dispensing head can be reused while the inner case can be replaced or refilled when the liquid product accommodated inside the inner case has been completely exhausted.

According to an aspect of the present disclosure, the outer case has a tubular body having an open upper end and an open lower end, and having a sidewall. The outer case includes a hollow cavity for receiving and housing the inner case therein. Further, the sidewall of the outer case includes an upper portion having a reduced diameter in comparison with the diameter of the rest of the sidewall of the outer case. An outer peripheral surface of the upper portion of the sidewall of the outer case is configured to engage with the dialer such that the dialer can rotate a limited distance in a circumferential direction on the outer case. An outer surface of the upper portion of the sidewall of the outer case includes features that allow the dialer to rotate both clockwise and anticlockwise on the circumference of the sidewall in a limited manner. The outer case further includes a plurality of tabs that are formed on the upper portion of the outer case and a portion of each of the tabs extend upward from an upper edge of the upper portion of the outer case. More particularly, as shown the upper portion of the outer case includes four tabs that are uniformly and circumferentially separated. Each of the four tabs has teeth at its free upper end. Each of the tabs further includes a snap protrusion on its outer surface and located below the teeth for engaging with a corresponding snap groove present in the collar. Each of the tabs has a guide rail groove formed therein in which a corresponding slide protrusion of the dialer can slide along a circumferential direction of the outer case when the dialer is rotated on the outer case.

In certain embodiments, the outer case may include a window or made up of a transparent material to reveal the inner case positioned coaxially inside the outer case. Optionally, the inner case may be made of transparent material or have a transparent window so that through the window of the housing the product stored inside the inner case may be made visible.

According to another aspect of the present disclosure, the inner case is positioned co-axially inside the hollow cavity of the outer case for storing the liquid product. The inner case comprises a bottom wall and a sidewall that extends between an open upper end and a closed lower end of the inner case. The inner case includes locking features on an outer surface of the sidewall for removably engaging with corresponding locking features present on the dialer. The dialer couples the inner case to the outer case in a removable manner. The locking features of the inner case allow the inner case to be rotatably coupled to the dialer in a removable manner. The locking features in the present embodiment are preferably a plurality of J-lock features formed on the outer surface of the inner case which easily engages and disengages with complementary J-lock features of the dialer. The locking features on the inner case have a vertical rib and a lateral rib extending in a circumferential direction. Further, the locking features have a protrusion formed below the lateral rib forming a locking groove with the vertical rib in which at least one inner lug of the dialer is engaged to removably secure the inner case.

According to yet another aspect of the present disclosure, the piston is positioned within the tubular body of the inner case. The piston is sealingly and slidingly received in the inner case and is configured to push up the liquid product contained in the inner case. The piston is movable along a longitudinal axis of the inner case and reaches near the open upper end of the inner case when the liquid product inside the inner case is completely used.

According to yet another aspect of the present disclosure, the dialer is mounted on the outer surface of the outer case near the upper end portion of the outer case. The dialer is used to secure both the inner case and the outer case. In other words, the dialer is both coupled to the outer case and the inner case and allows the inner case to be coupled to the outer case in a removable manner. The dialer includes two concentric rings that are axially offset and are radially separated. The two concentric rings are namely an upper ring and a lower ring. The upper ring has a smaller diameter as compared to a diameter of the lower ring. The upper ring and the lower ring are connected through a plurality of linking ribs that extends horizontally to connect an outer surface of the upper ring to an inner surface of the lower ring. Further, the linking ribs are radial and are positioned such that there are hollow spaces between the adjacent linking ribs. In the embodiment shown, there are four linking ribs.

When the dialer is mounted on the outer case, the tabs of the outer case extend into the hollow spaces between the linking ribs of the dialler such that the lower ring b of the dialer encloses the upper portion of the outer case. When in the assembled state, the linking ribs seats on an upper edge of the outer case, and an inner surface of the upper ring is flush vertically with the inner surface of the outer case.

According to yet another aspect of the present disclosure, the upper ring is configured to allow removable coupling of the inner case with the upper ring, and the lower ring is configured to be rotatably and fixedly coupled to the outer case.

According to yet another aspect of the present disclosure, the dialer comprises inner lugs that are situated on an inner surface of the upper ring of the dialer which allows performing engagement and disengagement operation with the inner case. The inner lugs are circumferentially and uniformly separated from one another. The inner lugs of the dialer are engaged in the locking grooves of the J lock of the inner case to removably secure the inner case with the dialer. The inner case is thereby connected to the dialer using a J-lock which is easily connected and disconnected.

Further, the lower ring of the dialer is shaped and sized to fit over the upper portion of the outer case, more particularly, over the outer peripheral surface of the upper portion of the sidewall of the outer case such that the dialer is arranged to rotate to a limited degree on the outer case.

Furthermore, at least one circumferential defining means is provided to limit the dialer to rotate within a predetermined angular range in relation to the outer case and includes an inner projection and two outer stop projections. The two outer stop projections extend from the outer surface of the upper portion of the sidewall of the outer case, and the inner projection extends an inner surface of the lower ring of the dialer. When the dialer rotates relative to the outer case, the inner projection of the lower ring is limited to rotate within a predetermined angular range between the two outer stop projections.

According to yet another aspect of the present disclosure, the predetermined angular range between the two outer stop projections is 5-30 degrees. Preferably, the predetermined angle is between 10-15 degrees, more preferably 15 degrees so that the dialer is limited to rotate at 15 degrees such that the inner lugs of the dialer are displaced rotatably either in or out from the locking grooves of the J lock of the inner case depending on a direction of rotation of the collar to secure or disengage the inner case from the dialer and the outer case.

Furthermore, the lower ring includes a plurality of slide protrusions formed on the inner surface of the lower ring that is configured to slide on the corresponding plurality of the guide rails formed on the tabs of the outer case the smooth sliding rotation can be ensured thereby when the dialer is rotated on the outer case.

According to yet another aspect of the present disclosure, the dialer can only be rotated in the circumferential direction within an angular range of at least 10±degrees.

According to yet another aspect of the present disclosure, the collar is mounted on the extended portion of the outer case to enclose it. The collar comprises an annular sidewall having an open upper end and an open lower end. The collar comprises a horizontal wall that extends from an inner surface of the sidewall of the collar and is spaced from the open upper end and the open lower end of the sidewall of the collar. The horizontal wall includes a hollow tubular body for accommodating the pump assembly therein. The nozzle cylinder is elastically supported at its lower surface by the spring. Therefore, the downwardly pressurized nozzle cylinder may rise by the spring when the external force is removed.

According to yet another aspect of the present disclosure, the collar includes teeth extending from a bottom surface of the horizontal wall. Further, an inner surface of the sidewall of the collar includes the snap groove just below the teeth of the collar. The extended portion of the tabs of the outer case passes through the spaces between the linking ribs of the dialer to non-rotatably engage with the collar. The snap groove of the collar engages with the snap protrusions located on the outer surface extended portion of the tabs. Thus, the outer case and the collar are coupled to each other through snap fitment. The teeth provided on the extended portion of the outer case, mate with the teeth of the collar for a non-rotatable engagement.

According to yet another aspect of the present disclosure, when the inner case is received with the hollow cavity of the outer case and locked with the dialer, the horizontal wall of the collar seals the upper ends of both the outer case and the inner case. Further, a seal may be provided between a bottom surface of the horizontal wall of the collar and the open upper end of the inner case to provide an airtight seal.

According to yet another aspect of the present disclosure, the dispensing head has a structure in which a lower portion is opened and an upper portion has an upper wall. A circumferential sidewall extends downward from an edge of the upper wall. In addition, a nozzle corresponding to a passage through which liquid product is discharged is formed at the center of the upper wall. When the top cover is opened, the dispensing head is exposed to the outside. The user may operate the pump by downwardly pressing the dispensing head exposed to the outside.

According to yet another aspect of the present disclosure, the top cover is detachably mounted on the collar to prevent the accumulation of dirt and dust on the dispenser. The top cover is removably engaged to the collar by means of a snap fitment. The collar comprises at least one corresponding protrusion on an outer surface of the collar which engages with corresponding at least one groove on an inner surface of the top cover.

In alternate embodiments, the top cover and the collar may be coupled by any other engagement means capable of removably coupling the top cover and the collar e.g. j-lock, magnetic engagement, screw threads, etc.

According to yet another aspect of the present disclosure, a lower end of the sidewall of the dispensing head is inserted into the collar through the open upper end of the collar such that the dispensing head is slidable in an axial direction with respect to the collar. The liquid product is dispensed through the nozzle formed on the upper wall of the dispensing head, and the user may use the liquid product on the upper surface by using a puff (not shown) or fingers.

The dispensing head is elastically supported at its lower surface by the spring. Therefore, the downwardly pressurized dispensing head may rise by the spring when the external force is removed.

Furthermore, the holder is coupled at the open lower end of the outer case and closing the lower end of the outer case. The holder comprises means to removably hold and lock therewith the inner case. More particularly, the holder comprises means to removably hold and lock therewith a lower portion of the inner case. The holder includes a bottom wall, an outer sidewall, and an inner sidewall concentric with the outer sidewall. The inner sidewall comprises grooves on an inner periphery thereof configured to receive corresponding projections present on an outer surface of the sidewall of the inner case, the inner case thus can be rotatably coupled to the inner sidewall of the holder. The grooves of the holder are L-shaped grooves. Each of the groove of the holder has a long arm and a short arm. The long arm of the groove is from the periphery of the inner sidewall. The short arm of the groove extends from a lower end of the long arm in a circumferential direction such that the short arm of the groove is perpendicular to the long arm. For locking the inner case within the holder, the projections of the inner case are aligned with and inserted in the long arm of the L-shaped groove of the holder and the inner case is rotated in a first direction along the short arm so that projections slide along the short arm of the L-shaped groove. Similarly, to unlock the inner case from the holder is rotated in a second direction opposite to the first direction.

Furthermore, the inner sidewall comprises at least one axial rib on an outer surface thereof that is received within an axial groove provided on the inner surface of the sidewall of the outer case so that the holder is non-rotatable with respect to the outer case. The outer sidewall of the holder flush with the sidewall of the outer case and completes an outer form of the dispenser.

Optionally, a decorative or metallic base cover may be provided that matches an outer profile of the outer surface of the holder.

Furthermore, the hollow tubular body protrudes downward from the bottom of the horizontal wall of the collar. The hollow tubular body has a hollow cylindrical shape and has a structure in which both top and bottom ends are open. The pump assembly is inserted into the inner space of the hollow tubular body.

According to yet another aspect of the present disclosure, a space is formed between a bottom surface of the upper wall of the dispensing head and an upper surface of the horizontal wall of the collar, and the pump head and the spring of the pump assembly are located therein.

According to yet another aspect of the present disclosure, the upper end of the pump head is in communication with the nozzle of the dispensing head. Therefore, the contents discharged through the pumping are directly introduced to the nozzle and then discharged to the upper wall of the dispensing head. One end of the spring is in contact with the bottom surface of the upper wall of the dispensing head and the other end is in contact with the upper surface of the horizontal wall of the collar. Therefore, the spring elastically supports the dispensing head at the lower portion of the dispensing head.

When the user presses the dispensing head downward, the dispensing head moves downward and the spring elastically contracts. The pump guide sucks the contents while the pump head moves downward by the downward movement of the dispensing head. When the external force applied to the dispensing head is removed, the dispensing head is raised by the elastic restoring force of the spring. As the dispensing head is raised, the pump head is also raised, which causes the pump guide h to rise, thereby causing a low pressure (low pressure close to vacuum or vacuum) to the inner space of the hollow tubular body.

When the low pressure is generated in the inner space, the liquid product filled in the inner case flows into the inner space, and a piston ascends accordingly.

The piston is located above the upper surface of the bottom wall of the inner case. A through-hole is formed in the bottom wall of the inner case, and atmospheric pressure may be applied to the piston through the through-hole. An outer contact surface of the piston is in close contact with an inner circumferential surface of the inner case. When the liquid product filled in the inner case is discharged by the pumping and the remaining amount decreases, the piston ascends due to the pressure drop in the inner case.

The hollow tubular body corresponding to the lower part of the pump assembly has a lower hole at its lower end. The lower hole corresponds to a passage through which contents enter the inner space.

According to yet another aspect of the present disclosure, a part of the pump guide and a pump piston are inserted into the hollow tubular body. The outer circumference of the pump piston is in close contact with the inner circumferential surface of the hollow tubular body, and the inner circumference is in close contact with the outer circumferential surface of the pump guide. The pump guide has a hollow cylindrical shape, the lower end of which is closed, and the upper end of the pump guide communicates with the nozzle. In addition, an inlet hole is formed around the pump guide. In addition, the pump piston d may be positioned around the inlet hole.

When the pump head is pressurized downward in a raised state, the pump guide descends and the inlet hole is separated from the pump piston. As a result, the inlet hole shielded by the pump piston is opened and the contents introduced into the inner space are introduced into the pump guide through the inlet hole. The liquid product is introduced into the pump guide is discharged to the upper surface of the upper wall of the dispensing head through the nozzle.

When the external force applied to the pump head is removed, the pump head is raised by the elastic restoring force of the spring, and the pump guide is also raised in association with the pump head. As the pump guide h rises, the inlet hole is shielded by the pump piston. In addition, a low pressure close to a vacuum is generated in the inner space by the rise of the pump guide, and thus the contents filled in the inside of the inner case flow into the inner space.

According to yet another aspect of the present disclosure, the piston is sealingly and slidingly received in the inner case in the bottom of the inner case. The piston is movable along a longitudinal axis of the inner case and reaches near the proximal end of the inner case when the liquid product inside the inner case is completely used.

The collar comprises an inner skirt around the hollow tubular body that encases a lower end of the spring, and a first skirt descends from the lower surface of the upper wall of the dispensing head that surrounds an upper end of the spring.

The check valve is positioned on the proximal end of the cavity. The check valve allows a one-way suction of the liquid product stored inside the inner case, wherein the one-way suction is typically from the proximal end to the distal end of the pump assembly.

When the inner case, encased by outer case, is in a locked position with the dialer, the inner lugs of the dialer are engaged in the locking grooves of the J lock of the inner case. For replacing the inner case a user grips a base cover or the holder or the outer case, and rotates the dialer slightly along the outer circumference of the outer case to unlock the inner case from the outer case. The dialer is rotated in a first direction preferably in a clockwise direction. As the dialer is rotated in the first direction, the inner lugs of the dialer come out of the locking grooves by overriding the protrusion of the J lock of the inner case and moves in a circumferential direction along the lateral protrusion a and finally disengaging from the dialer.

In this unlocked position, the inner case is detached from the outer case when inner lugs of the collar come out of the J lock of the inner case. The inner case comes out from the open lower end of the outer case along with the base cover and the holder.

The inner case is removed from the outer case and replaced with a filled new inner case upon the complete usage of the liquid product. The inner case is removed by disengaging the inner case by the dialer from the protrusions of the inner case. The inner case is disengaged by rotating the dialer with one hand and by gripping the base cover or the holder with another hand. When the dialer is disengaged and the inner case along with the holder and the base cover slide out in the downward direction. The at least one axial rib on the outer surface inner wall of the holder disengages from the axial groove provided on the inner surface of the sidewall of the outer case. The inner case then can be removed from the holder by detaching the projections of the inner case from the L-shaped grooves of the holder by rotating the inner case with respect to the holder.

A new inner case may have a protective seal at an upper end that is removed before use or before fitting the inner case within the outer case. The new inner case is locked in the holder and then inserted inside the outer case till the inner case is fully inserted in the outer case. The dialer is rotated in the locking direction so that the plurality of protrusions present in the inner case engages with the inner lugs of the dialer engage with corresponding locking grooves of the J lock of the inner case.

According to an embodiment, the outer case and the inner case are cylindrical shapes. However, the shape of the outer case and the inner case is chosen from rectangular, elliptical, cubical, cuboidal, and other such shapes known in the art.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the disclosure. In addition, those skilled in the art may readily change or modifications to the disclosed embodiments, based on the present specification, such changes or modifications also belong to the scope of the present disclosure will be apparent.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1A:
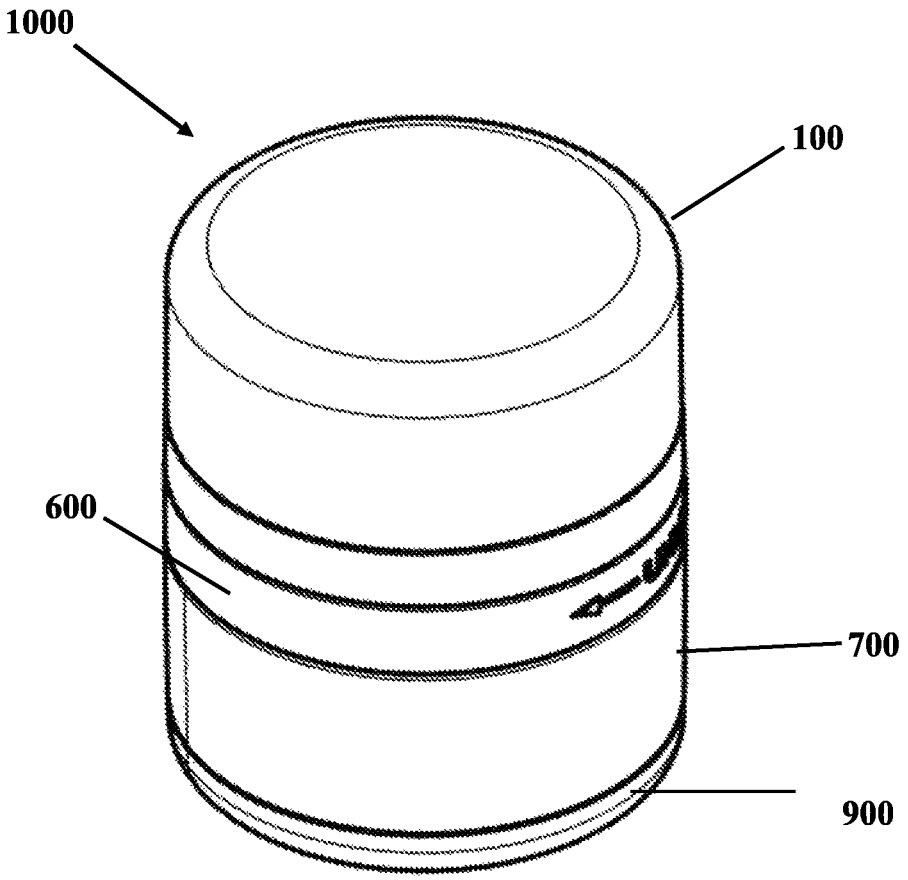
FIG. 1*a* illustrates an isometric view of a dispenser according to a preferred embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

Figure 1B:
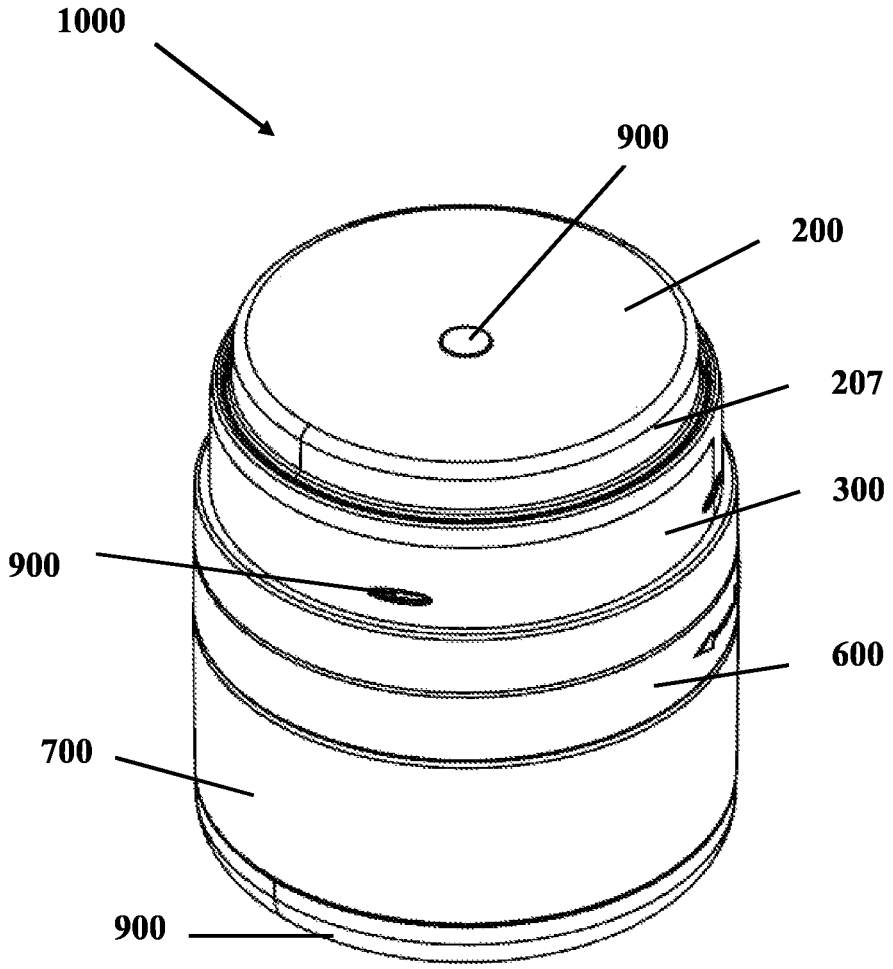
FIG. 1B illustrates an isometric view of the dispenser of FIG. 1*a*, without atop cover.
Figure 2:
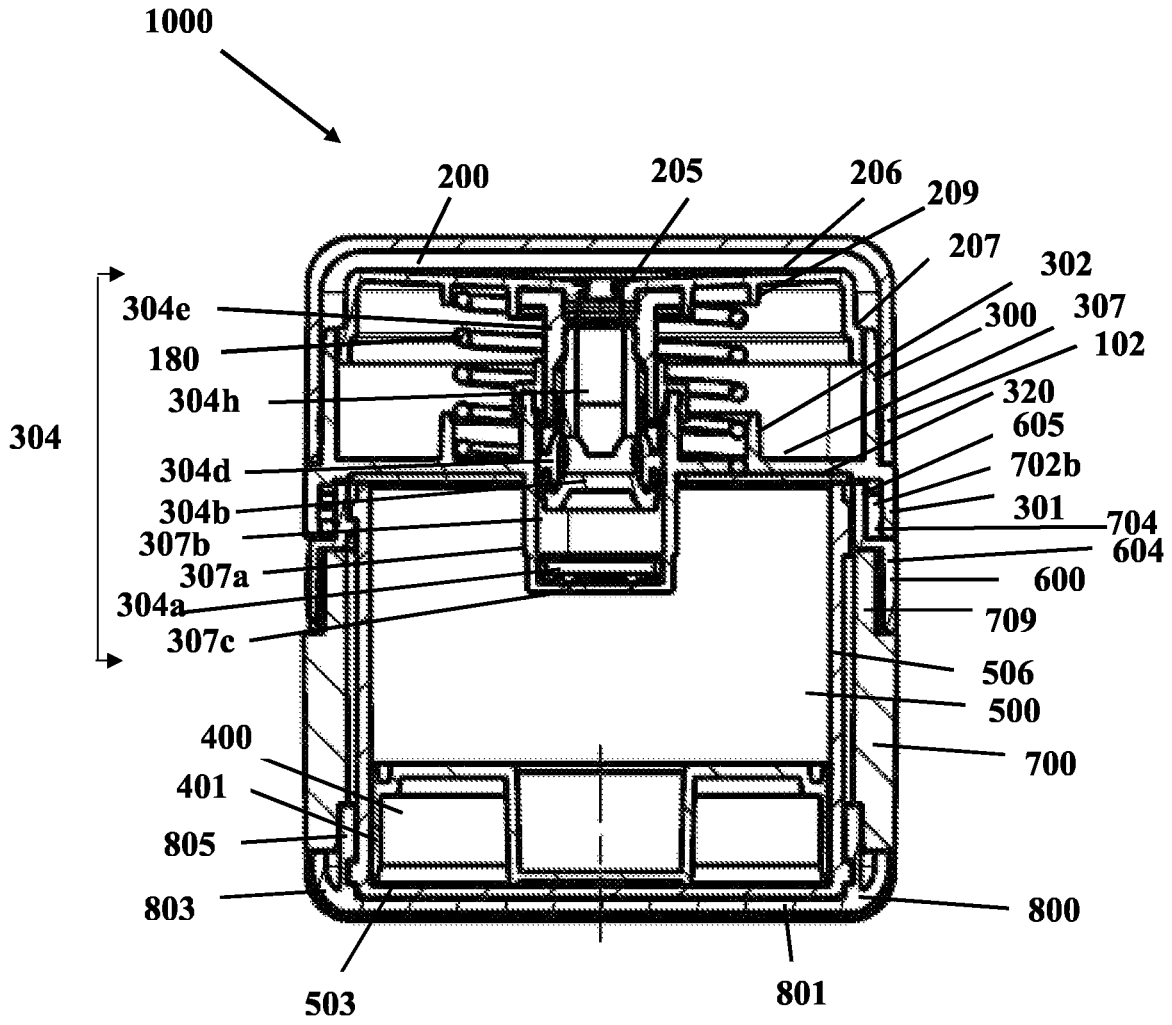
FIG. 2 illustrates a longitudinal cross sectional view of the dispenser of FIG. 1*a;*
Figure 3:
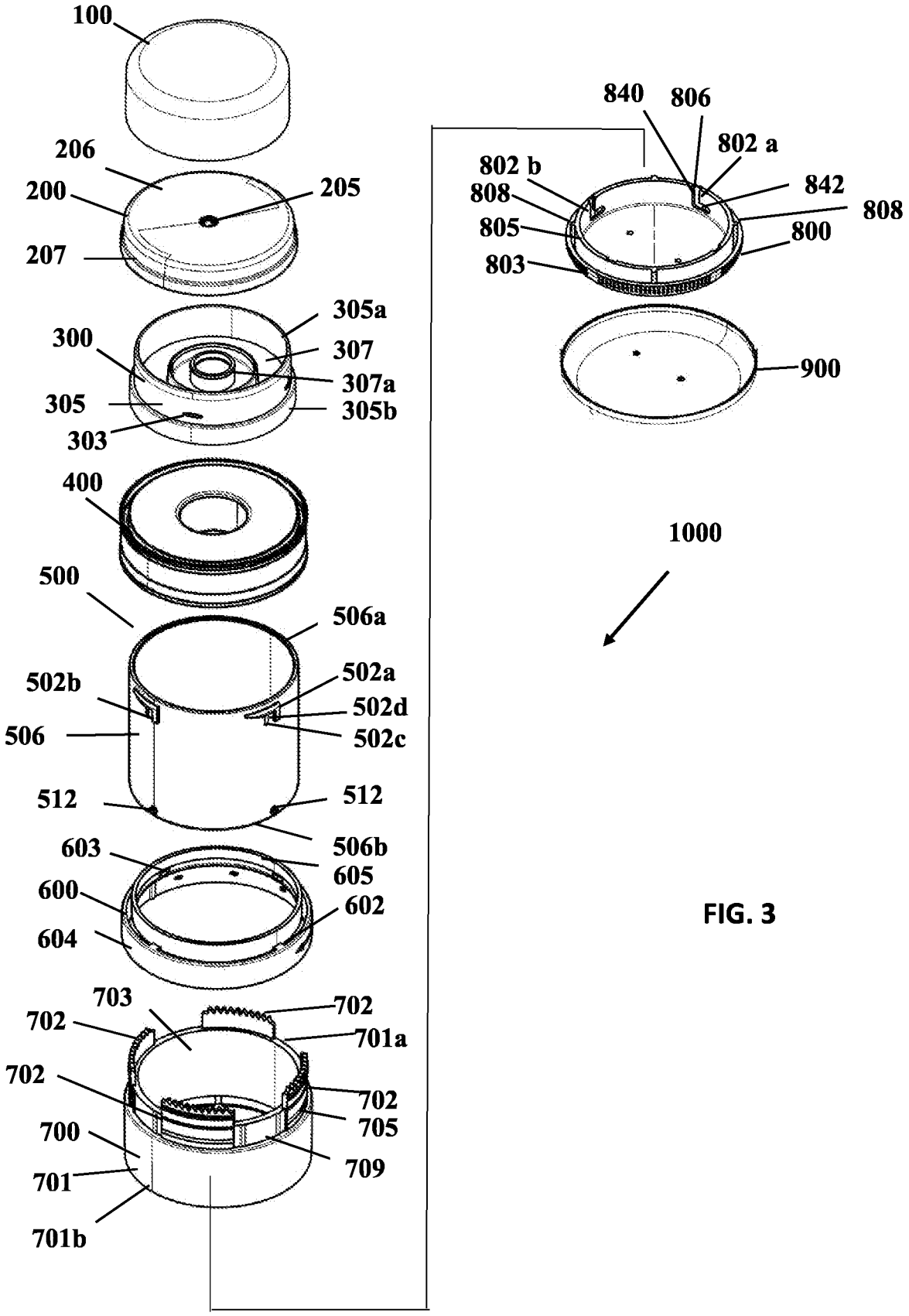
FIG. 3 illustrates an isometric exploded view of the dispenser of FIG. 1*a;*

FIGS. 1 to 3 illustrates a dispenser 1000 in accordance with an embodiment of the present disclosure. The dispenser 1000 comprises a top cover 100, a dispensing head 200, a collar 300, a pump assembly 304, a replaceable inner case 500, a piston 400, a dialer 600, an outer case 700, a holder 800, and a base cover 900. The replaceable inner case 500, herein after the inner case 500, stores a liquid product (not shown) that is to be dispensed onto an outer surface of the dispensing head 200, wherein the liquid product is selected from at least one of the cosmetic liquid products or medicinal liquid products. The liquid product stored in the inner case 500 is a flowable liquid product e.g. a solution, suspension, a viscous liquid, etc.

The replaceable inner case 500 is removably housed within the outer case 700 such that the outer case 700, the collar 300, the dialer 600, the pump assembly 304, and the dispensing head 200 can be reused while the inner case 500 can be replaced or refilled when the liquid product accommodated inside the inner case 500 has been completely exhausted. The inner case 500 is held within a hollow cavity 703 of the outer case 700 by the dialer 600 and wherein the inner case 500 is removably coupled to the dialer 600 such that on rotating the dialer 600 in a disengaging direction the inner case 500 disengages from the dialer 600 and can be removed from the hollow cavity 703 of the outer case 700.

As shown in FIGS. 1-3 and 6-7, the outer case 700 has a tubular body having an open upper end 701*a* and an open lower end 701*b*, and having a sidewall 701. The outer case 700 includes the hollow cavity 703 for receiving and housing the inner case 500 therein. Further, the sidewall 701 of the outer case 700 includes an upper portion 709 having a reduced diameter in comparison with the diameter of the rest of the sidewall 701 of the outer case 700.

An outer peripheral surface of the upper portion 709 of the sidewall 701 of the outer case 700 is configured to engage with the dialer 600 such that the dialer 600 can rotate a limited distance in a circumferential direction on the outer case 700. An outer surface of the upper portion 709 of the sidewall 701 of the outer case 700 includes features that allow the dialer 600 to rotate both clockwise and anticlockwise on the circumference of the sidewall 701 in a limited manner. The outer case 700 further includes a plurality of tabs 702 that are formed on the upper portion 709 of the outer case 700 and an extended portion 704 of each of the plurality of tabs 702 extend upward from an upper edge of the upper portion 709 of the outer case 700. More particularly, as shown in FIG. 3, the upper portion 709 of the outer case 700 includes four tabs 702 that are uniformly and circumferentially separated. Each of the four tabs 702 has teeth 702*a* at its free upper end. Each of the plurality of tabs 702 further includes a snap protrusion 702*b* on its outer surface and located below the teeth 702*a* for engaging with a corresponding snap groove 301 present in the collar 300. Each of the plurality of tabs 702 has a guide rail groove 705 formed therein in which a corresponding slide protrusion 607 of the dialer 600 can slide along a circumferential direction of the outer case 700 when the dialer 600 is rotated on the outer case 700.

In certain embodiments, the outer case 700 may include a window or made up of a transparent material to reveal the inner case 500 positioned coaxially inside the outer case 700. Optionally, the inner case 500 may be made of transparent material or have a transparent window so that through the window of the housing the product stored inside the inner case 500 may be made visible.

As shown in FIGS. 2-3, the inner case 500 is positioned co-axially inside the hollow cavity 703 of the outer case 700 for storing the liquid product. The inner case 500 comprises a bottom wall 503 and a sidewall 506 that extends between an open upper end 506*a* and a closed lower end 506*b* of the inner case 500. The inner case 500 includes locking features on an outer surface of the sidewall 506 for removably engaging with a corresponding locking features present on the dialer 600. The dialer 600 couples the inner case 500 to the outer case 700 in a removable manner. The locking features of the inner case 500 allow the inner case 500 to be rotatably coupled to the dialer 600 in a removable manner. The locking features in the present embodiment are preferably a plurality of J-lock features formed on the outer surface of the inner case 500 which easily engages and disengages with complementary J-lock features of the dialer 600. The locking features on the inner case 500 have a vertical rib 502*b* and a lateral rib 502*a* extending in a circumferential direction. Further, the each of the locking features further include a protrusion 502*c* formed below the lateral rib 502*a* forming a locking groove 502*d* with the vertical rib 502*b* in which corresponding inner lug 603 of the dialer 600 is engaged in order to removably secure the inner case 500.

As seen in FIG. 2, the piston 400 is positioned within the inner case 500. The piston 400 is sealingly and slidingly received in the inner case 500 and is configured to push up the liquid product contained in the inner case 500. The piston 400 is movable along a longitudinal axis of the inner case 500 and reaches near the open upper end 506*a* of the inner case 500 when the liquid product inside the inner case 500 is completely used.

Figure 4A:
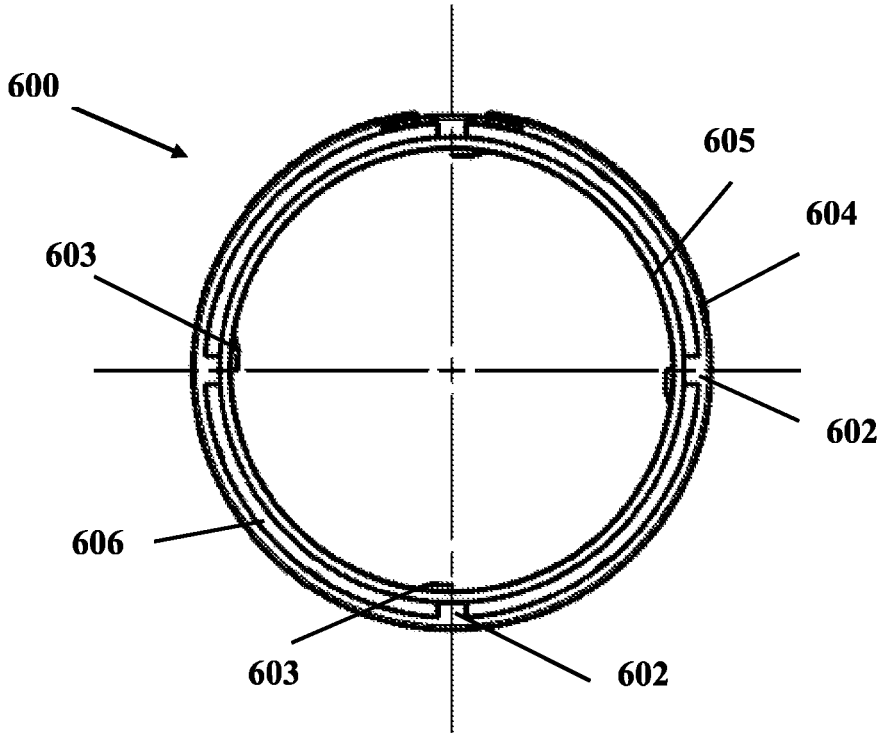
FIG. 4*a* illustrates a top view of a dialer of the dispenser of FIG. 1*a;*
Figure 4B:
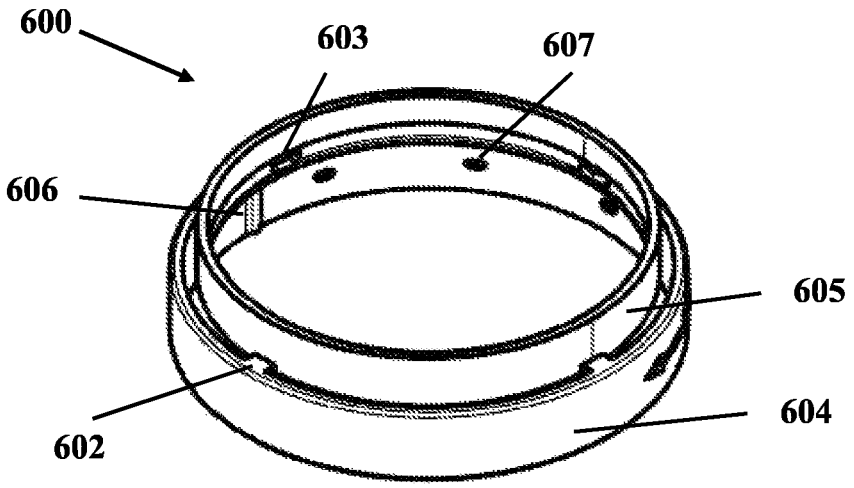
FIG. 4*b* illustrates an isometric view of the dialer of FIG. 4*a;*

As shown in FIG. 2, the dialer 600 is mounted on the outer surface of the outer case 700 near on upper portion 709 of the outer case 700. Both the inner case 500 and the outer case 700 are secured to the dialer 600. In other words, the dialer 600 is both coupled to the outer case 700 and the inner case 500, allowing the inner case 500 to be housed within the outer case 700 in a removable manner. As shown in FIGS. 3, 4*a* and 4*b*, the dialer 600 includes two concentric rings 605, 604 that are axially offset and are radially separated. The two concentric rings 605, 604 are namely an upper ring 605 and a lower ring 604. The upper ring 605 has a smaller diameter as compared to a diameter of the lower ring 604. The upper ring 605 and the lower ring 604 are connected through a plurality of linking ribs 602 that extends horizontally to connect an outer surface of the upper ring 605 to an inner surface of the lower ring 604. Further, the linking ribs 602 are radial and are positioned such that there are hollow spaces 606 between the adjacent linking ribs 602. In the embodiment shown, there are four linking ribs 602.

Figure 8:
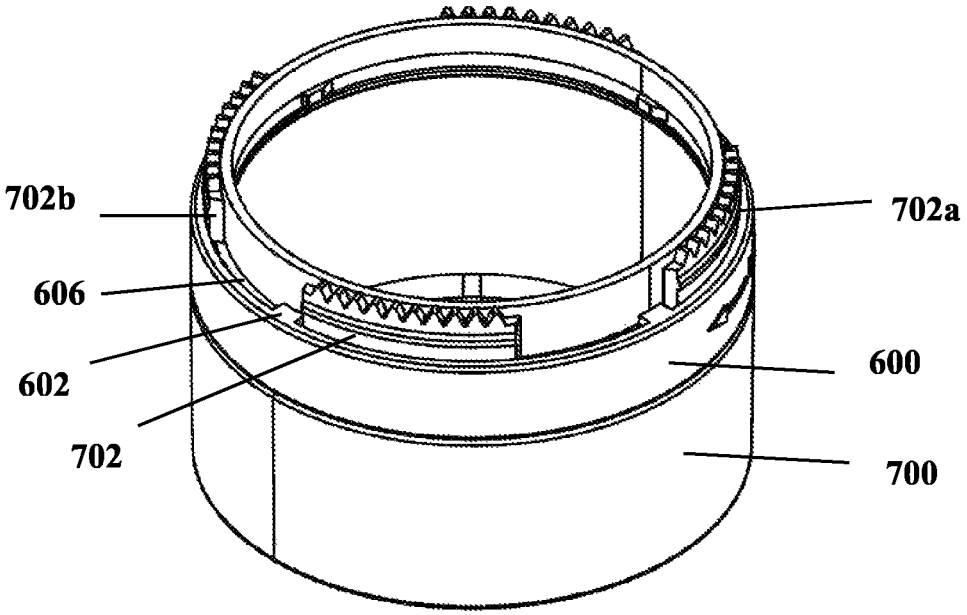
FIG. 8 illustrates an isometric view showing an outer case of the dispenser assembled with a dialer of the dispenser of FIG. 3.

As seen in FIGS. 2 and 8, when the dialer 600 is mounted on the outer case 700, the plurality of tabs 702 of the outer case 700 extends into the hollow spaces 606 between the linking ribs 602 of the dialer 600 such that the lower ring 604 of the dialer 600 encloses the upper portion 709 of the outer case 700. When in the assembled state, the linking ribs 602 seats on a upper edge of the outer case 700, and an inner surface of the upper ring 605 is flush vertically with the inner surface of the outer case 700.

The upper ring 605 is configured to be removably coupled to the inner case 500 and the lower ring 604 is configured to be rotatably coupled to the outer case 700.

As shown in FIGS. 4*a* and 4*b*, the dialer 600 comprises inner lugs 603 that are situated on an inner surface of the upper ring 605 of the dialer 600 which allows performing engagement and disengagement operation with the inner case 500. The inner lugs 603 are circumferentially and uniformly separated from one another. The inner lugs 603 of the dialer 600 are engaged in the locking grooves 502*d* of the J lock of the inner case 500 for removably secure the inner case 500 with the dialer 600. The inner case 500 is thereby connected to the dialer 600 using a J-lock which is easily connected and disconnected.

Further, the lower ring 604 of the dialer 600 is shaped and sized to fit over the upper portion 709 of the outer case 700, more particularly, over the outer peripheral surface of the upper portion 709 of the sidewall 701 of the outer case 700 such that the dialer 600 is arranged to rotate to a limited degree with on the outer case 700.

Figure 6:
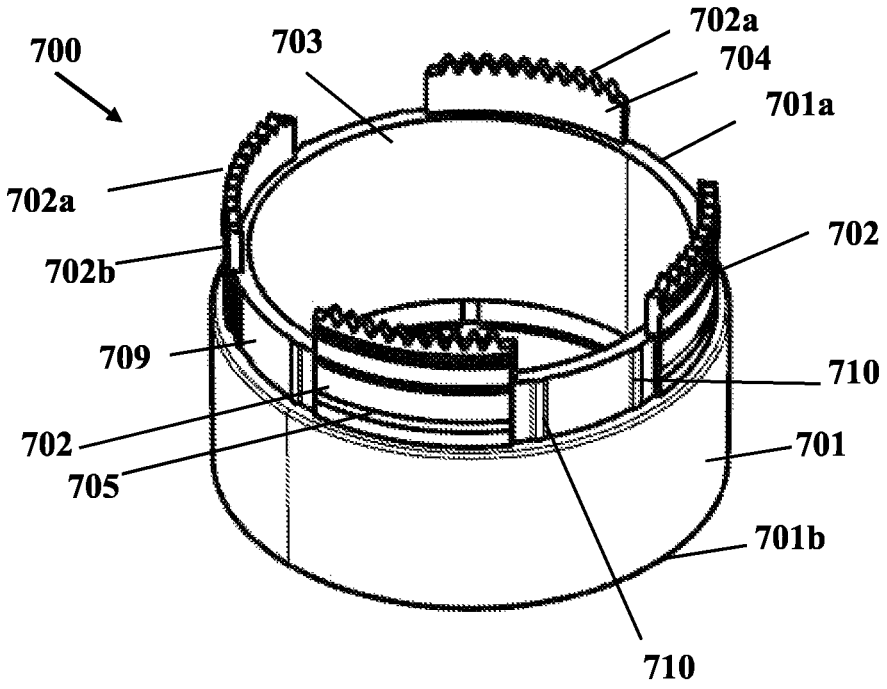
FIG. 6 illustrates a perspective view of an outer case of the dispenser of FIG. 3.

As shown in FIGS. 4*b* and 6, at least one circumferential defining means is provided to limit the dialer 600 to rotate within a predetermined angular range in relation to the outer case 700 and includes an inner projection 606 and two outer stop projections 710. The two outer stop projections 710 extend from the outer surface of the upper portion 709 of the sidewall 701 of the outer case 700, and the inner projection 606 extends an inner surface of the lower ring 604 of the dialer 600. When the dialer 600 rotates relative to the outer case 700, the inner projection 606 of the lower ring 604 is limited to rotate within a predetermined angular range between the two outer stop projections 710.

The predetermined angular range between the two outer stop projections 710 is 5-30 degrees. Preferably, the predetermined angle is 10 degrees so that the dialer 600 is limited to rotate at 10 degrees such that the inner lugs 603 of the dialer 600 are displaced rotatably either in or out from the locking grooves 502*d* of the J-lock of the inner case 500 depending on a direction of rotation of the dialer 600 to either secure or disengage the inner case 500 from the dialer 600 and the outer case 700.

Further, as seen in FIGS. 4*b* and 6, the lower ring 604 of the dialer 600 includes a plurality of slide protrusions 607 formed on the inner surface of lower ring 604 that is configured to slide on the corresponding plurality of the guide rails 705 formed on the plurality of tabs 702 of the outer case 700 so that a smooth sliding rotation can be ensured when the dialer 600 is rotated on the outer case 700.

The dialer 600 can only be rotated in the circumferential direction within an angular range of at least ±10 degrees.

As shown in FIGS. 2 and 3, the collar 300 is mounted on the extended portion 704 of the outer case 700 so as to enclose it. The collar 300 comprises an annular sidewall 305 having an open upper end 305*a* and an open lower end 305*b*. The collar 300 comprises a horizontal wall 307 that extends from an inner surface of the sidewall 305 of the collar 300 and is spaced from the open upper end 305*a* and the open lower end 305*b* of the sidewall 305 of the collar 300. The horizontal wall 307 includes a hollow tubular body 307*a* for accommodating the pump assembly 304 therein.

Figure 5A:
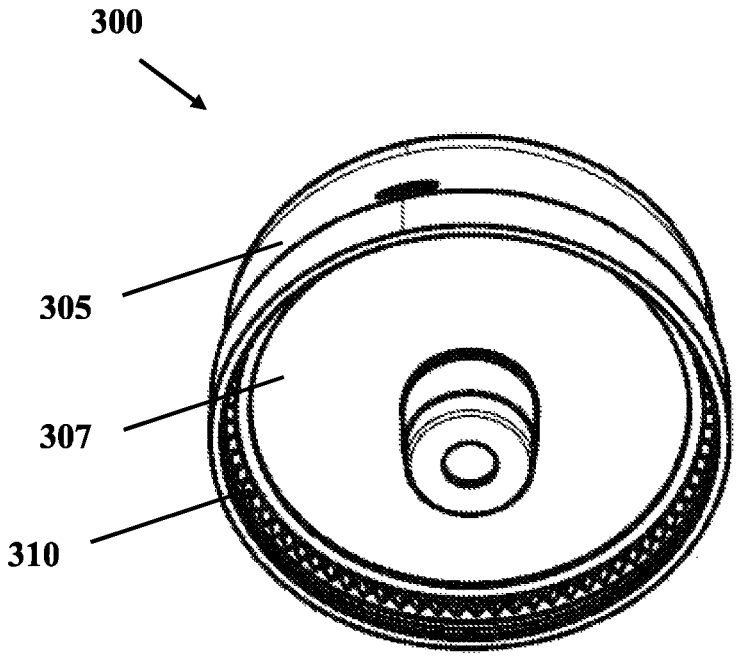
FIG. 5*a* illustrates a bottom perspective view of a collar of the dispenser of FIG. 1*b;*
Figure 5B:
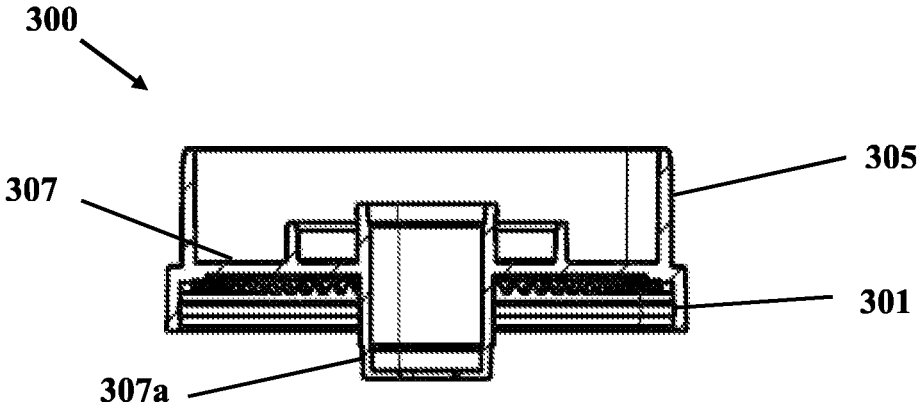
FIG. 5*b* illustrates a longitudinal cross sectional view of the collar of FIG. 5*a;*

As seen in FIGS. 5*a* and 5*b*, the collar 300 includes teeth 310 extending from a bottom surface of the horizontal wall 307 and near an inner peripheral surface of the horizontal wall 307. Further, an inner surface of the sidewall 305 of the collar 300 includes the snap groove 301 just below the teeth 310 of the collar 300. The extended portion 704 of each of the plurality of tabs 702 of the outer case 700 passes through the hollow spaces 606 between the linking ribs 602 of the dialer 600 to non-rotatably engage with the collar 300, see FIGS. 2 and 8. Referring FIGS. 5*b* and 6, the snap groove 301 of the collar 300 engages with the snap protrusions 702*b* located on the outer surface extended portions of the plurality of tabs 702 of the outer case 700. Thus, the outer case 700 and the collar 300 are coupled to each other through snap fitment. The teeth 702*a* provided on the extended portion 704 of the outer case 700 mate with the teeth 310 of the collar 300 for a non-rotatable engagement.

As seen FIG. 2, when the inner case 500 is received with the cavity 703 of the outer case 700 and locked with the dialer 600, the horizontal wall 307 of the collar 300 seals the upper ends of both the outer case 700 and the inner case 500. Further, a seal 320 may be provided between a bottom surface of the horizontal wall 307 of the collar 300 and the open upper end 506*a* of the inner case 500 to provide an airtight seal.

As seen in FIG. 3, the dispensing head 200 has a structure in which a lower portion is opened and an upper portion has an upper wall 206. A circumferential sidewall 207 extends downward from an edge of the upper wall 206. In addition, a nozzle 205 corresponding to a passage through which liquid product is discharged is formed at the center of the upper wall 206. When the top cover 100 is opened, the dispensing head 200 is exposed to the outside (see FIG. 1B). The user may operate the pump by downwardly pressing the dispensing head 200 exposed to the outside.

The top cover 100 is detachably mounted on the collar 300 to prevent the accumulation of dirt and dust on the dispenser 1000. The top cover 100 is removably engaged to the collar 300 by means of a snap fitment. As shown in FIG. 3, the collar 300 comprises at least one corresponding protrusion 303 on an outer surface of the collar 300 which engages with corresponding at least one groove 102 (see FIG. 2) on an inner surface of the top cover 100.

In alternate embodiments, the top cover 100 and the collar 300 may be coupled by any other engagement means capable of removably coupling the top cover 100 and the collar 300 e.g. j-lock, magnetic engagement, screw threads, etc.

A lower end of the sidewall 207 of the dispensing head 200 is inserted into the collar 300 through the open upper end 305*a* of the collar 300 such that the dispensing head 200 is slidable in an axial direction with respect to the collar 300. The liquid product is dispensed through the nozzle 205 formed on the upper wall 206 of the dispensing head 200, and the user may use the liquid product on the upper wall 206 by using a puff (not shown) or fingers.

The dispensing head 200 is elastically supported at its lower surface by the spring 180. Therefore, the downwardly pressurized dispensing head 200 may rise by the spring 180 when the external force is removed.

Furthermore, the holder 800 is coupled at the open lower end 701*b* of the outer case 700 and closing the open lower end 701*b* of the outer case 700, see FIG. 2. Referring to FIGS. 2 and 3, the holder 800 comprises means to removably hold and lock there within the inner case 500. More particularly, the holder 800 comprises means to removably hold and lock therewith a lower portion of the inner case 500. The holder 800 includes a bottom wall 801, an outer sidewall 803, and an inner sidewall 805 concentric with the outer sidewall 803. The inner sidewall 805 comprises grooves 806 on an inner periphery thereof configured to receive corresponding projections 512 present on an outer surface of the sidewall 506 of the inner case 500, the inner case 500 thus can be rotatably coupled to the inner sidewall 805 of the holder 800. The grooves 806 of the holder 800 are preferably L-shaped groves 806. The L-shaped groove 806 has a long arm 840 and a short arm 842. The long arm 840 of the L-shaped groove 806 is from the periphery of the inner sidewall 805. The short arm 842 of the L-shaped groove 806 extends from a lower end of the long arm 840 in a circumferential direction such that the short arm 842 of the L-shaped groove 806 is perpendicular to the long arm 840. For locking the inner case 500 within the holder 800, the projections 512 of the inner case 500 are aligned with and inserted in the long arm 840 of the L-shaped groove 806 of the holder 800 and the inner case 500 is rotated in a first direction along the short arm 842 so that projections 512 slide along the short arm 842 of the L-shaped groove 806.

Similarly, to unlock the inner case 500 from the holder 800 is rotated in a second direction opposite to the first direction.

Figure 7:
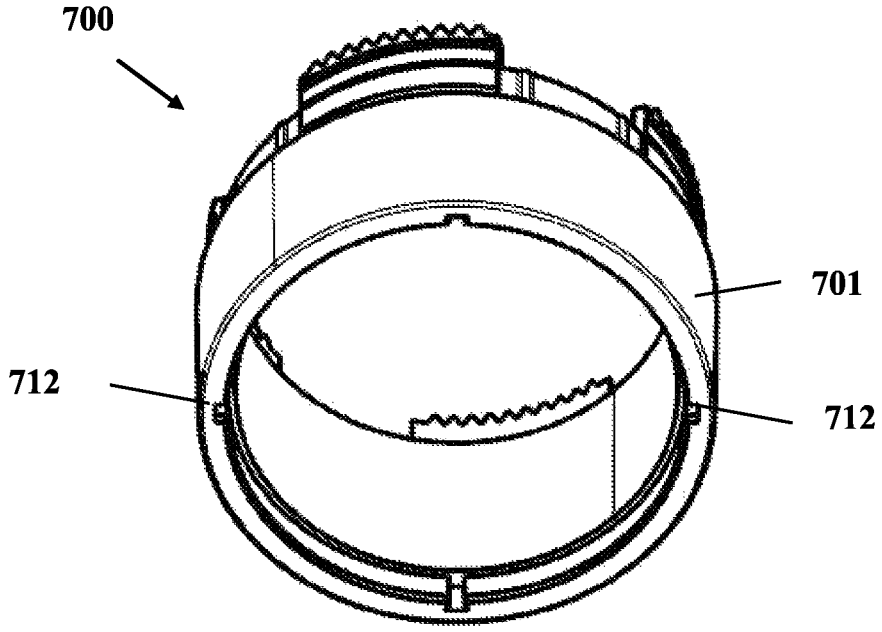
FIG. 7 illustrates a bottom perspective view of the outer case of FIG. 6.

Furthermore, as shown in FIGS. 3 and 7, the inner sidewall 805 comprises at least one axial rib 808 on an outer surface thereof that is received within an axial groove 712 provided on the inner surface of the sidewall 701 of the outer case 700 so that the holder 800 is non-rotatable with respect to the outer case 700. The outer sidewall 803 of the holder 800 flush with the sidewall 701 of the outer case 700 and completes an outer form of the dispenser 1000.

Optionally, a decorative or metallic base cover 900 may be provided that matches an outer profile of the outer sidewall 803 of the holder 800.

Further, the hollow tubular body 307*a* protrudes downward from the bottom of the horizontal wall 307 of the collar 300. The hollow tubular body 307*a* has a hollow cylindrical shape and has a structure in which both top and bottom ends are open. The pump assembly 304 is inserted into the inner space 307*b* of the hollow tubular body 307*a*.

As shown in FIG. 2, a space is formed between a bottom surface of the upper wall 206 of the dispensing head 200 and an upper surface of the horizontal wall 307 of the collar 300, and a pump head 304*e* and the spring 180 of the pump assembly 304 are located therein.

The upper end of the pump head 304*e* is in communication with the nozzle 205 of the dispensing head 200. Therefore, the contents discharged through the pumping are directly introduced to the nozzle 205 and then discharged to the upper wall 206 of the dispensing head 200. One end of the spring 180 is in contact with the bottom surface of the upper wall 206 of the dispensing head 200 and the other end is in contact with the upper surface of the horizontal wall 307 of the collar 300. Therefore, the spring 180 elastically supports the dispensing head 200 at the lower portion of the dispensing head 200.

When the user presses the dispensing head 200 downward, the dispensing head 200 moves downward and the spring 180 elastically contracts. The pump guide 304*h* sucks the contents while the pump head 304*e* moves downward by the downward movement of the dispensing head 200. When the external force applied to the dispensing head 200 is removed, the dispensing head 200 is raised by the elastic restoring force of the spring 180. As the dispensing head 200 is raised, the pump head 304*e* is also raised, which causes the pump guide 304*h* to rise, thereby causing a low pressure (low pressure close to vacuum or vacuum) to the inner space 307*b* of the hollow tubular body 307*a*.

When the low pressure is generated in the inner space 307*b*, the liquid product filled in the inner case 500 flows into the inner space 307*b*, and a piston 400 ascends accordingly.

The piston 400 is located above the upper surface of the bottom wall 503 of the inner case 500. At least one through-hole is formed in the bottom wall 503 of the inner case 500, and atmospheric pressure may be applied to the piston 400 through the through-hole (not shown). An outer contact surface 401 of the piston 400 is in close contact with an inner circumferential surface of the inner case 500. When the liquid product filled in the inner case 500 is discharged by the pumping and the remaining amount decreases, the piston 400 ascends due to the pressure drop in the inner case 500.

The hollow tubular body 307*a* corresponding to the lower part of the pump assembly 304 has a lower hole 307*c* at its lower end. The lower hole 307*c* corresponds to a passage through which contents enter the inner space 307*b*.

A part of the pump guide 304*h* and a pump piston 304*d* are inserted into the hollow tubular body 307*a*. The outer circumference of the pump piston 304*d* is in close contact with the inner circumferential surface of the hollow tubular body 307*a*, and the inner circumference is in close contact with the outer circumferential surface of the pump guide 304*h*. The pump guide 304*h* has a hollow cylindrical shape, the lower end of which is closed, and the upper end of the pump guide 304*h* communicates with the nozzle 205. In addition, an inlet hole 304*b* is formed around the pump guide 304*h*. In addition, the pump piston 304*d* may be positioned around the inlet hole 304*b*.

When the pump head 304*e* is pressurized downward in a raised state, the pump guide 304*h* descends and the inlet hole 304*b* is separated from the pump piston 304*d*. As a result, the inlet hole 304*b* shielded by the pump piston 304*d* is opened and the contents introduced into the inner space 307*b* are introduced into the pump guide 304*h* through the inlet hole 304*b*. The liquid product is introduced into the pump guide 304*h* is discharged to the upper surface of the upper wall 206 of the dispensing head 200 through the nozzle 205.

When the external force applied to the pump head 304*e* is removed, the pump head 304*e* is raised by the elastic restoring force of the spring 180, and the pump guide 304*h* is also raised in association with the pump head 304*e*. As the pump guide 304*h* rises, the inlet hole 304*b* is shielded by the pump piston 304*d*. In addition, a low pressure close to a vacuum is generated in the inner space 307*b* by the rise of the pump guide 304*h*, and thus the liquid product filled in the inside of the inner case 500 flow into the inner space 307*b*.

As seen in FIG. 2, the collar 300 comprises an inner skirt 302 around the hollow tubular body 307*a* that encases a lower end of the spring 180, and a first skirt 209 descends from the lower surface of the upper wall 206 of the dispensing head 200 that surrounds an upper end of the spring 180.

The check valve 304*a* is positioned on the proximal end of the inlet hole 304*b*. The check valve 304*a* allows a one-way suction of the liquid product stored inside the inner case 500, wherein the one-way suction is typically from the proximal end to the distal end of the pump assembly 304.

When the inner case 500, encased by the outer case 700, is in a locked position with the dialer 600, the inner lugs 603 of the dialer 600 are engaged in the locking grooves 502*d* of the J lock of the inner case 500. For replacing the inner case 500 a user grips a base cover 900 or the holder 800 and rotates the dialer 600 slightly along the outer circumference of the outer case 700 to unlock the inner case 500 from the dialer 600 and thus releasing the inner case 500 housed in the outer case 700 from the open lower end 701*b* of the outer case 700. When the inner case 500 is disengaged, the inner case 500 along with the holder 800 which holds the inner case 500 and the base cover 900 slide out in the downward direction. The dialer 600 is rotated in a first direction preferably in a clockwise direction. As the dialer 600 is rotated in the first direction, the inner lugs 603 of the dialer 600 come out of the locking grooves 502*d* by overriding the protrusion 502*c* of the J lock of the inner case 500 and moves in a circumferential direction along the lateral rib 502*a* and finally disengaging from the dialer 600. The at least one axial ribs 808 on the outer surface inner wall 805 of the holder 800 disengages from the axial groove 712 provided on the inner surface of the sidewall 701 of the outer case 700, allowing the holder 800 to slide downward. The inner case 500 then can be removed from the holder 800 by twisting inner case 500 relative to the holder 800 which disengages the projections 512 of the inner case 500 from the L-shaped grooves 806 of the holder 800.

The inner case 500 is thus removed from the outer case 700 and replaced with a filled new inner case 500. A new inner case 500 may have a protective seal at the open upper end 506*a* that is removed before use or before fitting the inner case 500 within the outer case 700. In order to lock a new inner case 500 with the outer case 700, the new inner case 500 is received within and locked with the holder 800. The projections 512 of the inner case 500 are thus inserted in the L-shaped grooves 806 and twisted gently to attach the inner case 500 with the holder 800. Thus, the new inner case 500 is locked in the holder 800 and then inserted inside the outer case 700 till the inner case 500 is fully inserted in the outer case 700. The dialer 600 is rotated in the locking direction so the inner lugs 603 of the dialer 600 engage with corresponding grooves 502*d* of the J lock of the inner case 500.

According to an embodiment, the outer case 700 and the inner case 500 are cylindrical shapes. However, the shape of the outer case 700 and the inner case 500 is chosen from rectangular, elliptical, cubical, cuboidal, and other such shapes known in the art.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A dispenser for dispensing a liquid product, the dispenser comprising:

an outer case having a sidewall extending between an open upper end and an open lower end of the outer case;

an inner case removably housed in a hollow cavity of the outer case; the inner case houses the liquid product therein;

a piston is positioned within the inner case to push up the liquid product contained in the inner case;

a dialer coupled to an outer surface of the sidewall of the outer case near the open upper end of the outer case such that the dialer is able to rotate a limited distance both in a clockwise and an anti-clockwise direction on the sidewall of the upper case;

a holder configured to removably hold the inner case and enclose a lower portion of the inner case;

a collar coupled to the open upper end of the outer case, and configured to hold a pump assembly;

a dispensing head coupled to an upper end of the pump assembly and having a nozzle for discharging the pumped liquid product onto an upper surface of the dispensing head;

wherein the pump assembly configured to pump liquid product stored in the inner case to the dispensing head;

wherein the inner case is replaceable;

wherein the inner case is removably coupled to the dialer such that on rotation of the dialer in one of the clockwise or the anti-clockwise direction the inner case disengages from the dialer;

wherein when the inner case is disengaged from the dialer, the inner case and the holder are configured to slide out from the outer case in a downward direction;

wherein the holder comprises grooves on an inner periphery thereof that are configured to receive corresponding projections present on an outer surface of a sidewall of the inner case so that the inner case can be rotatably and removably coupled to the holder;

wherein the holder is non-rotatably engaged to the sidewall of the outer case at the open lower end of the outer case; and wherein to disengage the inner case from the holder, the inner case is rotated relative to the holder so that the projections present on the outer surface of the sidewall of the inner case disengages from the grooves on the inner periphery of the holder.

2. A dispenser according to claim 1, wherein the outer case includes a plurality of tabs formed on an upper portion of the outer case, and wherein an extended portion of each of the plurality of tabs extend upward from an upper edge of the upper portion of the outer case; and wherein the dialer includes an upper ring and a lower ring that are axially and radially offset and are connected to each other through linking ribs that extend horizontally to connect an outer surface of the upper ring to an inner surface of the lower ring.

3. A dispenser according to claim 2, wherein hollow spaces are created between the adjacent linking ribs; and wherein the plurality of tabs of the outer case extends into the hollow spaces between the linking ribs of the dialer such that the lower ring of the dialer encloses the upper portion of the outer case.

4. A dispenser according to claim 2, wherein the extended portion of each of the plurality of tabs further includes a snap protrusion on an outer surface thereof for engaging with a corresponding snap groove present on an inner surface of a sidewall of the collar.

5. A dispenser according to claim 2, wherein two outer stop projections extend from the outer surface of the upper portion of the sidewall of the outer case, and an inner projection extends an inner surface of the lower ring of the dialer; wherein when the dialer rotates relative to the outer case, the inner projection of the lower ring limits the dialer to rotate within a predetermined angular range between the two outer stop projections of the outer case.

6. A dispenser according to claim 5, wherein the predetermined angular range is about 5-30 degrees.

7. A dispenser according to claim 1, wherein a plurality of J-lock features formed on the outer surface of the inner case which engages and disengages with complementary J-lock features formed on an inner surface of the dialer; wherein each of J-lock features on the inner case include a vertical rib and a lateral rib, a protrusion formed below the lateral rib to form a locking groove with the vertical rib; wherein each of the complementary J-lock features on the dialer includes an inner lug formed on the inner surface of the dialer that is configured to be engaged with the locking groove of the inner case in order to removably and rotatably secure the inner case.

8. A dispenser according to claim 2, wherein the collar is mounted on the extended portion of the outer case so as to enclose the extended portion of the outer case; wherein the collar comprises a sidewall and a horizontal wall that extends from an inner surface of the sidewall of the collar and is spaced from an open upper end and an open lower end of the collar.

9. A dispenser according to claim 8, wherein the horizontal wall of the collar includes a hollow tubular body for accommodating the pump assembly therein.

10. A dispenser according to claim 8, wherein the collar includes teeth extending from a bottom surface of the horizontal wall; wherein the extended portion of each of the plurality of tabs of the outer case has teeth formed at a free upper end thereof that pass through the hollow spaces provided between the linking ribs of the dialer to engage with the teeth of the collar for a non-rotatable engagement between the outer case and the collar.

11. A dispenser according to claim 1, wherein the pump assembly includes a pump guide, a pump piston, a spring, a pump head, and a check valve.

12. A dispenser according to claim 1, wherein the holder comprises a bottom wall, an outer sidewall, and an inner sidewall concentric with the outer sidewall; wherein the inner sidewall includes the grooves that are L-shaped on an inner periphery thereof configured to receive the corresponding projections present on the outer surface of the sidewall of the inner case.

13. A dispenser according to claim 12, wherein the inner sidewall of the holder comprises at least one axial rib on an outer surface thereof that is received within an axial groove provided on an inner surface of the sidewall of the outer case so that the holder is non-rotatable with respect to the outer case.

14. A dispenser according to claim 12, wherein the outer sidewall of the holder flush with the sidewall of the outer case and completes an outer form of the dispenser.

15. A dispenser according to claim 1, wherein a base cover is coupled to an outer surface of the holder and matches an outer profile of the outer surface of the holder and wherein the base cover has a metallic finish.

16. A dispenser according to claim 1, wherein the grooves of the holder are L-shaped.

17. A dispenser for dispensing a liquid product, the dispenser comprising:

an outer case having a sidewall extending between an open upper end and an open lower end of the outer case;

an inner case removably housed in a hollow cavity of the outer case; the inner case houses the liquid product therein;

a dialer coupled to an outer surface of the outer case near the open upper end of the outer case such that the dialer rotates a limited distance both in a clockwise and an anti-clockwise direction on the outer surface of the sidewall of the upper case;

a collar coupled to the open upper end of the outer case, and configured to hold a pump assembly;

a dispensing head coupled to an upper end of the pump assembly and having a nozzle for discharging the pumped liquid product onto an upper surface of the dispensing head;

wherein the pump assembly configured to pump liquid product stored in the inner case to the dispensing head;

wherein the inner case is removably coupled to the dialer such that on rotation of the dialer in one of the clockwise or the anti-clockwise direction the inner case disengages from the dialer and comes out from the hollow cavity of the outer case from the open lower end of the outer case; and wherein the outer case, the collar, the dialer, the pump assembly, and the dispensing head is configured to be reused while the inner case is replaced with a new inner case.

18. A dispenser according to claim 17, wherein a plurality of J-lock features formed on an outer surface of the inner case which engages and disengages with complementary J-lock features formed on an inner surface of the dialer; wherein each of J-lock features on the inner case include a vertical rib and a lateral rib, and a protrusion formed below the lateral rib to form a locking groove with the vertical rib; and wherein each of the complementary J-lock features on the dialer includes at least one inner lug formed on the inner surface of the dialer that engages with the locking groove of the inner case in order to removably and rotatably secure the inner case.

19. A dispenser according to claim 17, wherein the dispenser further comprises a holder at the open lower end of the outer case; wherein the holder comprises a bottom wall, an outer sidewall, and an inner sidewall concentric with the outer sidewall; wherein the inner sidewall comprises L-shaped grooves on an inner periphery thereof that are configured to receive corresponding projections present on an outer surface of a sidewall of the inner case to removably hold the inner case.

20. A dispenser for dispensing a liquid product, the dispenser comprising:

an outer case having a sidewall extending between an open upper end and an open lower end of the outer case;

an inner case removably housed in a hollow cavity of the outer case; the inner case houses the liquid product therein;

a dialer coupled to an outer surface of the sidewall of the outer case near the open upper end of the outer case such that the dialer is configured to rotate a limited distance both in a clockwise and an anti-clockwise direction on the outer surface of the sidewall of the upper case;

a collar coupled to the open upper end of the outer case;

a pump assembly is configured to pump liquid product stored in the inner case to a dispensing head;

a holder configured to removably hold the inner case and enclose a lower portion of the inner case;

wherein the holder is non-rotatably engaged to the sidewall of the outer case at the open lower end of the outer case;

wherein the dispensing head coupled to an upper end of the pump assembly and having a nozzle for discharging the pumped liquid product onto an upper surface of the dispensing head;

wherein the inner case is removably coupled to the dialer such that on rotation of the dialer in one of the clockwise or the anti-clockwise direction the inner case disengages from the dialer;

wherein when the inner case is disengaged from the dialer, the inner case and the holder are configured to slide out from the outer case in a downward direction; and wherein the holder, the outer case, the collar, the dialer, the pump assembly, and the dispensing head is reused while the inner case is replaced with a new inner case.

* * * * *